US008032991B2

(12) United States Patent
Lawless

(10) Patent No.: US 8,032,991 B2
(45) Date of Patent: Oct. 11, 2011

(54) PRY BAR ERGONOMIC HANDLE

(75) Inventor: John C. Lawless, Charlemont, MA (US)

(73) Assignee: Mayhew Steel Products, Inc., Turner Falls, MA (US)

( * ) Notice: Subject to any disclaimer, the term of this patent is extended or adjusted under 35 U.S.C. 154(b) by 747 days.

(21) Appl. No.: 11/247,299

(22) Filed: Oct. 11, 2005

(65) Prior Publication Data

US 2006/0026800 A1 Feb. 9, 2006

Related U.S. Application Data

(63) Continuation-in-part of application No. 10/429,463, filed on May 5, 2003, now Pat. No. 7,523,525.

(51) Int. Cl.
*B25G 1/10* (2006.01)

(52) U.S. Cl. ..... 16/430; 40/913; 81/489

(58) Field of Classification Search ..... 16/110.1, 16/421, 430, 431, 436; 81/177.1, 177.2, 81/177.3, 177.4, 177.5, 489–492; 40/596, 40/616, 618, 913
See application file for complete search history.

(56) References Cited

U.S. PATENT DOCUMENTS

| | | | | | |
|---|---|---|---|---|---|
| 3,825,226 | A * | 7/1974 | Appleman | 254/28 |
| 4,712,304 | A | 12/1987 | Sanelli | |
| 5,031,881 | A * | 7/1991 | Thurmston | 254/28 |
| 5,390,572 | A | 2/1995 | Gakhar | |
| 5,475,894 | A * | 12/1995 | Wildforster | 16/430 |
| 5,816,119 | A * | 10/1998 | Herue | 81/60 |
| 5,824,181 | A * | 10/1998 | Salyer et al. | 156/379.8 |
| D414,095 | S * | 9/1999 | Hoepfl et al. | D8/83 |
| 5,956,799 | A | 9/1999 | Panaccione | |
| 5,964,009 | A * | 10/1999 | Hoepfl et al. | 16/430 |
| 6,058,809 | A | 5/2000 | Flanz | |
| 6,295,903 | B1 * | 10/2001 | Tipper et al. | 81/489 |
| 6,471,186 | B1 * | 10/2002 | Lawless | 254/25 |
| 6,663,082 | B1 * | 12/2003 | Ploeger | 254/21 |
| 6,772,994 | B1 * | 8/2004 | Lawless | 254/25 |
| 2002/0078531 | A1 * | 6/2002 | Chen | 16/421 |
| 2002/0134971 | A1 | 9/2002 | Christensen | |
| 2003/0200843 | A1 * | 10/2003 | Lin | 81/438 |

FOREIGN PATENT DOCUMENTS

JP 62117708 A * 5/1987

* cited by examiner

*Primary Examiner* — William L. Miller

(74) *Attorney, Agent, or Firm* — Lackenbach Siegel, LLP

(57) ABSTRACT

A heavy duty hand tool handle has specifically configured thermoplastic and overmolded elastomeric material, with a thermoplastic grip and thumb receiving recesses for equal right and left hand ergonomic use. Metal indicia are forcibly embedded in the thermoplastic case to provide e.g. safety information which remains legible in long term heavy duty abrasive use.

9 Claims, 4 Drawing Sheets

PRY BAR ERGONOMIC HANDLE

PRIOR RELATED APPLICATIONS

This application is a continuation-in-part of U.S. application Ser. No. 10/429,463, filed May 5, 2003, now U.S. Pat. No. 7,523,525.

BACKGROUND OF THE INVENTION

1. Field of the Invention

This invention relates to hand tool handles. Specifically, this invention relates to hand tool ergonomic handles, particularly including heavy duty use hand tool handles, and more particularly pry bar handles.

2. Background and Discussion of the Prior Art

In general, heavy duty hand tools such as pry bars and wrecking tools are of all metal construction and are cumbersome to grip and use. Often the user has to grip a rectilinear metal portion of the hand tool in use. One such prior art construction is disclosed in U.S. Pat. No. 6,058,809 to Flanz. A wrecking tool is disclosed in U.S. Patent Application Publication No. 2002/0134971 to Christensen. The Christensen heavy duty wrecking tool has an elongated octagonal cross-sectional metal handle or bar stock portion. A non-octagonal handgrip is slidably attached to the octagonal metal bar.

It is generally known to provide a soft elastomeric molded over cover on a molded hard thermoplastic core for improved grip for knives, screwdrivers, and like bladed tools. Such prior art constructions are disclosed in Sanelli, U.S. Pat. No. 4,712,304; Gakhar, U.S. Pat. No. 5,390,572; Hoepfl, U.S. Pat. No. 5,964,009; and Panaccione, U.S. Pat. No. 5,956,799. Generally these handles do not provide sufficient ergonomic character and do not sufficiently accommodate both right and left handed use.

U.S. Pat. No. 6,471,186 and U.S. Pat. No. 6,772,994 granted to Lawless the inventor herein, which Lawless patents are commonly owned with the present application, disclose improvements wherein a metal end cap and pry bar shank are molded into a unitary thermoplastic core, and an elastomeric material is over-molded on the thermoplastic core. A ribbed elastomeric surface was provided in the radially extending distally disposed flange for finger engagement.

Handles that undergo heavy duty or industrial use consequently undergo considerable wear, particularly frictional wear. Where such handles are conventionally imprinted with indicia, the printed indicia would in time wear away and become less legible or illegible. This wear impediment was particularly prevalent in heavy duty tool handles, particularly pry bar handles. Such heavy duty tool handles often require government regulatory safety notices to be imprinted on the handles and remain legible throughout the useful life of the tool.

The hand tool art desires a handle that had long term wear resistant indicia.

The hand tool art also desires an improved ergonomic grip heavy duty handle, particularly with improved ergonomic characteristics equally for both right and left handed users.

It is therefore a principal object of the present invention to provide an ergonomic handle and hand tool.

It is another principal object of the present invention to provide an improved grip hand tool handle having heavy duty wear resistant indicia.

It is another object of the present invention to provide an improved ergonomic handle for a heavy duty hand tool as aforesaid that provides equal ergonomic characteristics for both right and left handed users.

It is still another object the present invention to provide a hand tool handle as aforesaid with diverse functionality.

It is another object of the present invention to provide a hand tool handle as aforesaid for heavy duty pry bar use.

It is still a further object of the present invention to provide a hand tool as aforesaid which is practical in design, manufacture and use.

SUMMARY OF THE INVENTION

A handle for a heavy duty hand tool, such as a pry bar, is formed of a hard thermoplastic core and a soft elastomeric cover integrally bonded to the hard thermoplastic core and partially covering the core. The selectively uncovered portions of the handle core provide ergonomically effective surfaces and permanent indicia bearing surfaces. A plurality of thermoplastic grip surfaces and a plurality of thermoplastic thumb engaging recesses are formed of the core thermoplastic, and are specifically disposed to provide equal ergonomic characteristics for both right and left handed use. Metal sheet material is forcibly embedded in at least one of the elongated thermoplastic grip surfaces, whereby the embedded metal indicia retains its readability with extended heavy duty use. The embedded indicia provides product information and regulatory safety information. A metal impact cap is fixedly disposed in the handle core proximate end and is in co-molded facing disposition to the pry bar blade, to provide complementary heavy duty impact functionality.

DESCRIPTION OF THE PREFERRED EMBODIMENTS

Figure 1:
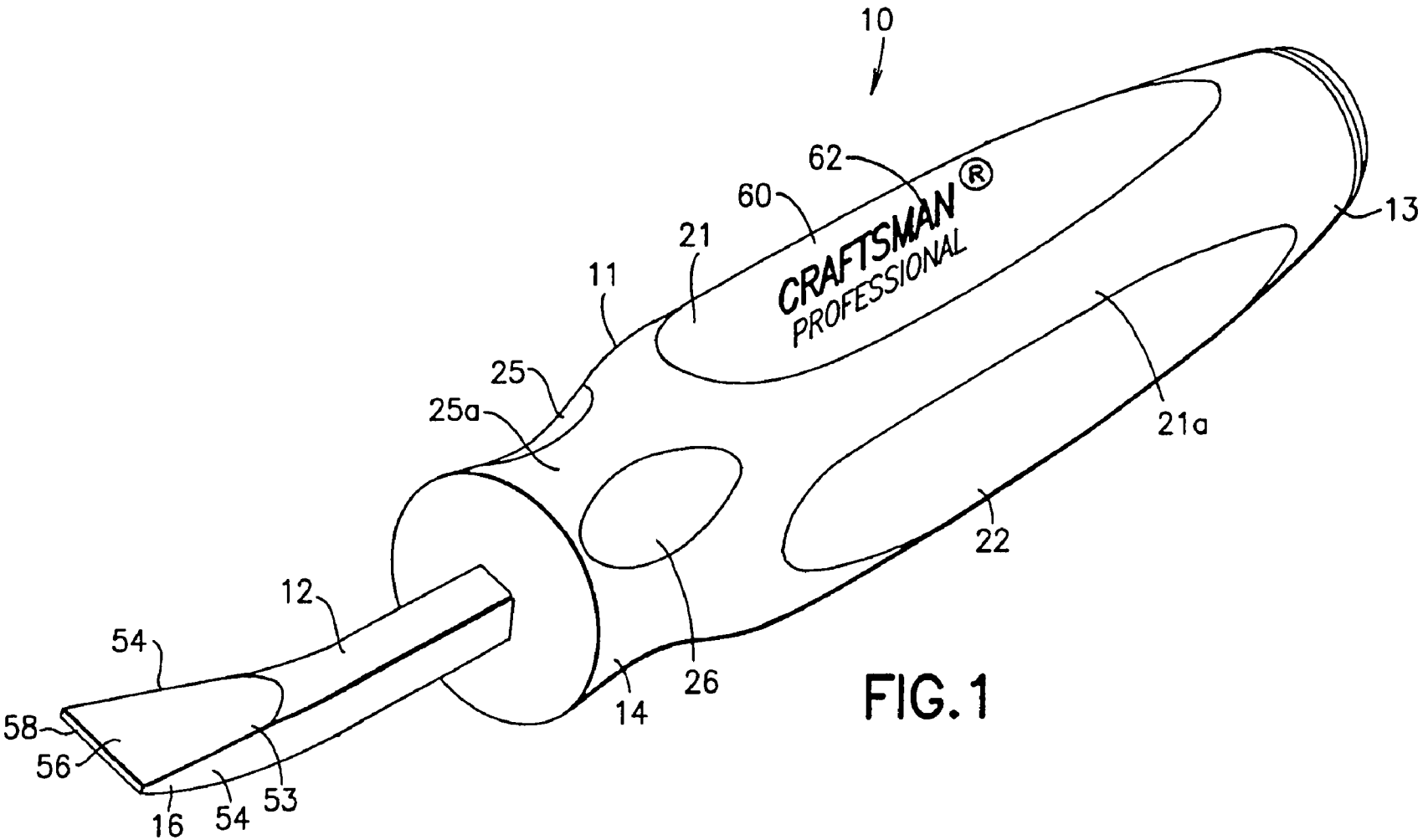
FIG. 1 is a perspective view of the pry bar of present invention.
Figure 2:
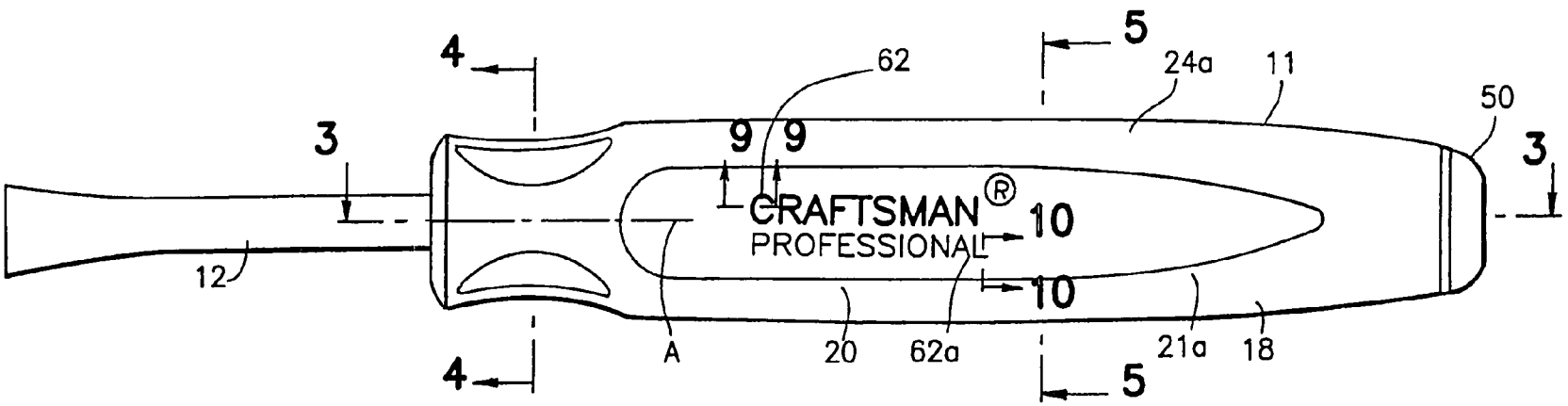
FIG. 2 is a top plain view of the pry bar of FIG. 1.

Referring to the FIGS., there is shown pry bar 10 having handle 11 and a proximate end 13 and a distal end 14, and a blade or shank 12. Blade 12 is of generally rectilinear sectional construction and has a proximate end 15 and a distal end 16. Handle 11 is formed of a hard thermoplastic molded core 17 and a molded over integrally bonded elastomeric cover 18. Cover 18 is formed of relatively soft elastomeric material.

The proximate end 15 of blade 12 is securely fixedly molded in core 17, with the formation of core 17 as at 17*a*, by means known in the art. The elastomeric cover 18 is then integrally molded over and bonded to the core by means well known in the knife, screwdriver, and like bladed hand tool handle prior art. Certain specifically contoured designed portions of the core are left uncovered, for purposes hereinafter appearing.

Handle 11 has grip surface or 20 has two proximately tapered elongated hard thermoplastic planar top and bottom grip portions 21 and 23, two proximately tapered planar elastomeric side grip portions 22, and 24 four contoured elastomeric corner surfaces 21*a*, 22*a*, 23*a*, and 24*a*, and two spacedly disposed oval hard thermoplastic thumb recesses 25 and 26. Recesses 25 and 26 are disposed on opposite sides of and equally spaced from adjacent handle centerline A of grip portion 20, for purposes hereinafter appears. The oval recesses are surrounded by elastomeric portions 25*a* and 26*a*. The oval recesses importantly in combination with the other grip portions provides improved ergonomic characteristics for both right and left hand use.

Grip portions 21 and 23 are permanently imprinted with metal (e.g. gold) indicia 60 and 61 respectively. Metallic indicia 60 and 61 are formed from a metal sheet or foil A drive or stamping platen (not shown) drives the metal foil under high pressure into the hard thermoplastic surfaces 21 and 23.

It has been found that by applying heat and more particularly high pressure to a metal foil, indicia such as a trademark 62, product information 62*a* and regulatory safety information 63, 63*a*, 63*c* can be permanently embedded into the hand tool handle. The embedded indicia is found to be highly wear resistant. The embedded or imprinted indicia was found to withstand the high pressure sandblast wear resistance test, namely ASTM D968- Method A, which ASTM test standard is incorporated herein by reference thereto. This ASTM test standard involves high pressure, high volume sandblasting. The selected metal indicia may exhibit greater abrasion resistance than the adjacent hard thermoplastic material. It is known in the art to embed or imprint gold leaf or foil under heat and pressure onto a hard thermoplastic surface. Methods for imprinting or embedding gold leaf in transfer foils on hard thermoplastic surfaces are described in U.S. Pat. No. 4,275,116, granted Jun. 23, 1981 to Kratschmer; U.S. Pat. No. 5,827,603, granted Oct. 27, 1998 to Suss; U.S. Pat. No. 5,980,679, granted Nov. 9, 1999 to Severin et al; U.S. 2004/0144479, published Jul. 29, 1004 to Cuel; and U.S. Pat. No. 6,280,823 granted Aug. 28, 1001 to Preisler et al; which references are incorporated herein by reference thereto.

Figure 11:
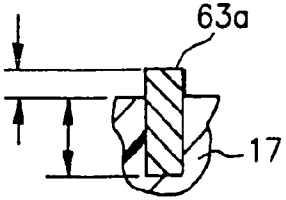
FIG. 11 is a greatly enlarged fragmentary sectional view taken along line 11-11 of FIG. 8.
Figure 10:
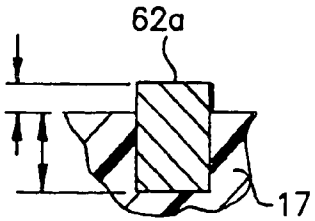
FIG. 10 is a greatly enlarged fragmentary sectional view taken along line 10-10 of FIG. 2.
Figure 9:
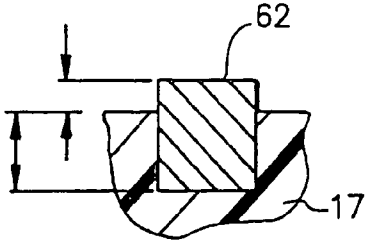
FIG. 9 is a greatly enlarged fragmentary sectional view taken along 9-9 of FIG. 2.

Referring specifically to FIGS. 9-11, there is shown metal indicia, 60, 61, 62, 62*a*, 63, 63*a*, 63*c* embedded in thermoplastic surfaces 21 and 23. The embedded metal is disposed at or extending slightly from thermoplastic surfaces. The embedded or height of the metal is about the same as the face or height of the adjacent elastomeric surface. In heavy duty use, the metal may undergo some abrasive loss, but importantly the of the metal is retained and indicia remains legible.

Figure 3:
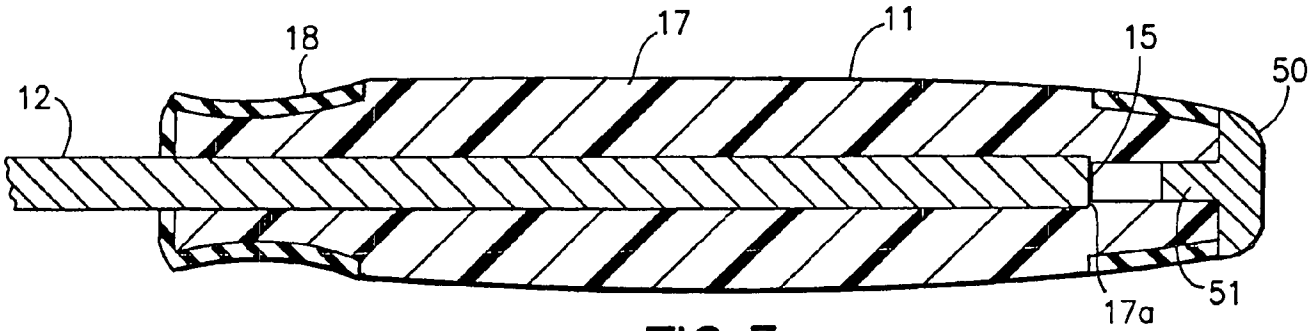
FIG. 3 is a sectional view taken along line 3-3 of FIG. 2.
Figure 5:
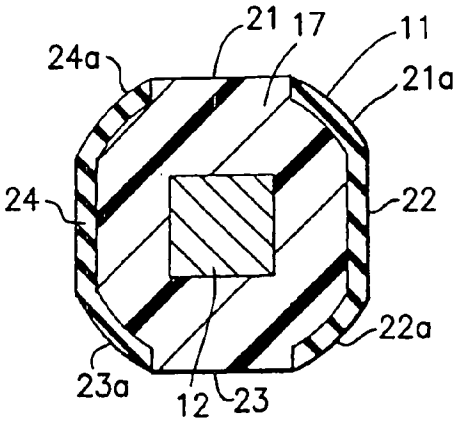
FIG. 5 is an enlarged sectional view taken along line 5-5 of FIG. 2.
Figure 4:
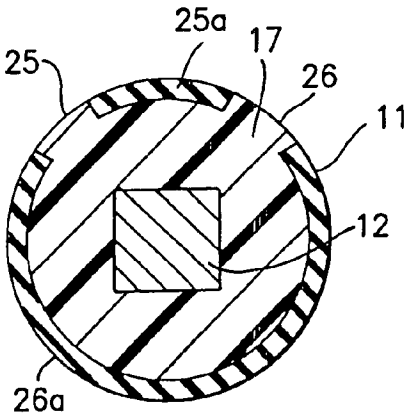
FIG. 4 is an enlarged sectional view taken along line 4-4 of FIG. 2.
Figure 6:
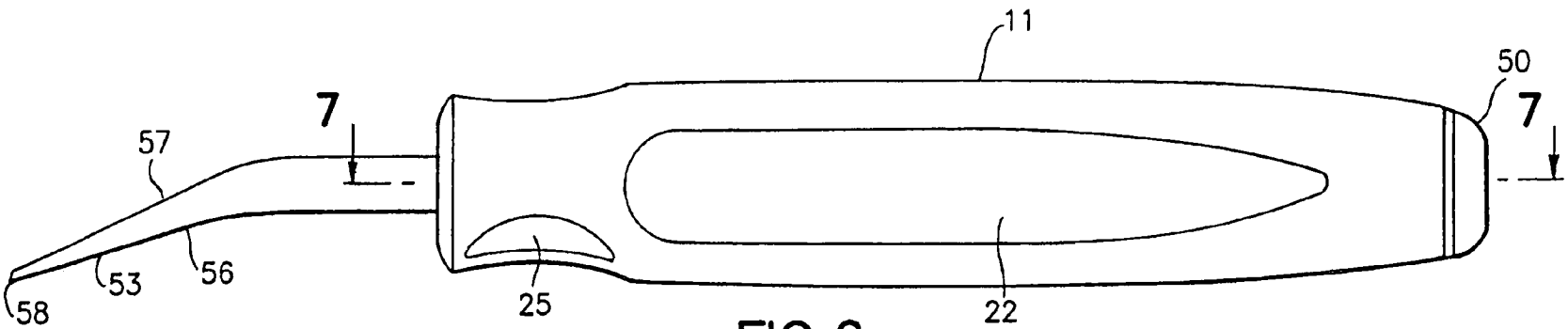
FIG. 6 is a side elevated view of the pry bar of FIG. 1.
Figure 7:
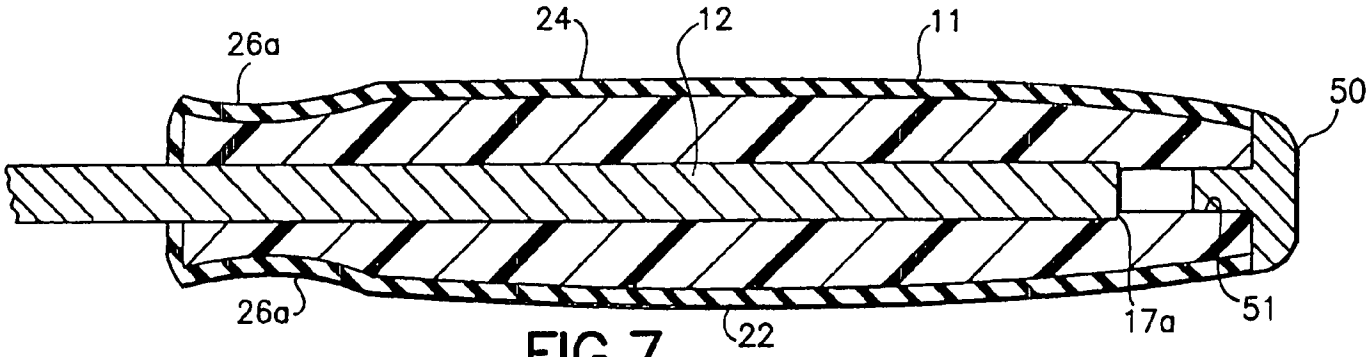
FIG. 7 is a sectional view taken along line 7-7 of FIG. 6.
Figure 8:
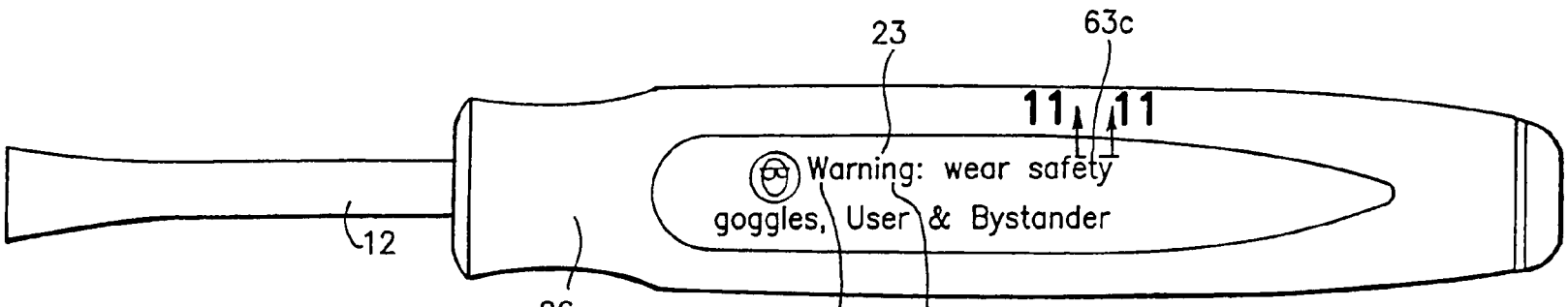
FIG. 8 is a bottom view of the pry bar of FIG. 1.

A metal impact cap 50 is fixedly disposed at the proximate end 13 of the handle 11. Cap 50 has a prong 51 which is fixedly secured and molded within the handle core 17, as best shown in FIGS. 3 and 7. Cap 50 is used by way of example to impact screw heads prior to screw driving same. Metal cap 50 in handle 11 is constructed for heavy impact operations.

Blade 12 is of square or rectilinear cross-sectional metal construction. Blade 12 has a proximate end 15 and a distal end 16. Proximate end 15 is molded in situ with the formation core 17, so as to be fixedly secured within handle 11, by means well known in the art. Blade distal end 16 is formed with a pry end 53. Pry end 53 has outwardly tapered sides 54, and upper and lower surfaces 56 and 57. Surfaces 56 and 57 are distally tapered, and extend towards sharpened edge or tip 58. Tip 58 is upwardly angularly disposed with respect to bladel2. Blade 12 is fixedly disposed in handle 11 distal end 14.

In the aforesaid manner of construction, there is provided an ergonomic hand tool and handle. More specifically, elongated distally tapered grip surfaces 21-24 and specifically the alternate hard and soft elongated tapered surface in combination with contoured elastomeric corners 21*a*-24*a*, and the specifically positioned spacedly disposed alternate thumb engaging recesses 25-26 provide alternate right or left handed user ergonomic grips. That is, the user has equal right and left hand ergonomic effects. And regardless of the hand used, the handle provides comfort and reduced fatigue and particularly as compared with conventional heavy duty use hand tools.

The core may be preferably formed of a hard thermoplastic material and the cover may be formed of a right elastomeric material as are well known in the hand tool handle art.

The afore-discussed handle surfaces and contours, and in conjunction with the hand tool configuration and disposition with respect to the handle, provides an equal left and right hand ergonomic grip hand tool.

While the foregoing describes certain embodiments of the invention, various modifications and changes may be made within the spirit and scope of the invention, as defined by the adjoined claims.

What is claimed is:

1. A tool handle comprising:

a thermoplastic core comprising a central hole for receiving a shank;

an elastomeric covering formed on the thermoplastic core;

indicia forming material disposed within the thermoplastic core, said indicia material having indicia formed thereon;

wherein the indicia material comprises a metallized sheet or foil, said sheet or foil has a predetermined thickness, said sheet or foil does not comprise a predetermined shape of the indicia to be formed, and wherein the indicia material by the predetermined thickness thereof extends outwardly from the thermoplastic core to a height about equal to a height of the elastomeric material, whereby the indicia is legible after being subjected to sandblasting under pressure, according to ASTM D968, Method A.

2. The tool handle of claim 1, said shank comprising a pry bar angularly disposed distal end.

3. The tool handle of claim 1, said handle thermoplastic core having an upper surface and a lower surface, said elastomeric material covers the thermoplastic core upper surface and lower surface.

4. The tool handle of claim 1, said indicia material being fixedly disposed in the thermoplastic core.

5. A pry bar comprising:

a handle having a distal end, a proximate end, and a through hole extending from the handle distal end to the handle proximate end;

a grip portion disposed between the handle distal end and the handle proximate end, said grip portion comprising a thermoplastic core and an elastomeric material covering the core;

two thumb receiving recesses being formed in the thermoplastic core disposed between the handle distal end and the handle proximate end;

a blade, said blade having a proximate end and a distal end, said blade proximate end being secured within said handle distal end, said blade being elongate, said blade distal end being formed with a pry end, said pry end being in angular disposition;

an impact cap disposed in the through hole adjacent to the proximate end of the handle; and wherein said thermoplastic core comprises an upper grip surface and a lower grip surface, said upper surface comprises product information indicia, and said lower grip surface comprises safety information indicia, wherein the indicia is formed from a metallized sheet or foil disposed within the thermoplastic core, said sheet or foil has a predetermined thickness, said sheet or foil does not comprise a predetermined shape of the indicia, wherein the sheet or foil by the predetermined thickness thereof extends outwardly from the thermoplastic core to a height about equal to the height of the elastomeric material, whereby the indicia is legible after being subjected to a sandblasting under pressure test comprising ASTM D968, Method A.

6. The tool handle of claim 5, said upper surface comprises thermoplastic material right and left thumb receiving recesses disposed adjacent to the distal end of the handle.

7. The tool handle of claim 5, said lower surface comprising an elastomeric material index finger receiving surface.

8. The tool handle of claim 5, said indicia having an abrasion resistance greater than said thermoplastic core.

9. The tool handle of claim 8, said indicia having a gold appearance.

* * * * *